US011424534B2

(12) United States Patent
Park

(10) Patent No.: US 11,424,534 B2
(45) Date of Patent: Aug. 23, 2022

(54) STAND-TYPE PORTABLE ANTENNA

(71) Applicant: WIWORLD CO., LTD., Daejeon (KR)

(72) Inventor: Chan Goo Park, Daejeon (KR)

(73) Assignee: WIWORLD CO., LTD., Daejeon (KR)

( * ) Notice: Subject to any disclaimer, the term of this patent is extended or adjusted under 35 U.S.C. 154(b) by 111 days.

(21) Appl. No.: 17/092,078

(22) Filed: Nov. 6, 2020

(65) Prior Publication Data

US 2021/0151851 A1 May 20, 2021

(30) Foreign Application Priority Data

Nov. 18, 2019 (KR) ..... 10-2019-0147688

(51) Int. Cl.
*H01Q 1/12* (2006.01)
*H01Q 3/08* (2006.01)
*H01Q 15/16* (2006.01)

(52) U.S. Cl.
CPC ..... *H01Q 3/08* (2013.01); *H01Q 1/1235* (2013.01); *H01Q 15/16* (2013.01)

(58) Field of Classification Search
CPC ..... H01Q 3/08; H01Q 15/16
See application file for complete search history.

(56) References Cited

U.S. PATENT DOCUMENTS 5,560,256 A * 10/1996 Tines ..... H01Q 3/04 248/292.12
5,619,215 A * 4/1997 Sydor ..... H01Q 3/08 343/765
6,188,367 B1 * 2/2001 Morrison ..... H01Q 1/125 343/765
6,204,823 B1 * 3/2001 Spano ..... H01Q 21/065 343/705
6,285,338 B1 * 9/2001 Bai ..... H01Q 19/13 343/882
6,317,093 B1 * 11/2001 Harris ..... H01Q 1/1257 343/765
6,538,612 B1 * 3/2003 King ..... H01Q 1/125 343/765
7,477,203 B2 * 1/2009 Park ..... H01Q 3/04 343/765
8,314,735 B2 * 11/2012 Park ..... H01Q 1/3275 342/359
8,531,347 B2 * 9/2013 Kirby ..... H01Q 1/1207 343/878
9,912,052 B2 * 3/2018 Evans ..... F16M 11/046
11,038,253 B1 * 6/2021 Tseng ..... H01Q 1/288
2002/0011958 A1 * 1/2002 Ogawa ..... H01Q 25/00 343/763

(Continued)

FOREIGN PATENT DOCUMENTS

KR 20190040725 A 4/2019

*Primary Examiner* — Ab Salam Alkassim, Jr.
(74) *Attorney, Agent, or Firm* — McCoy Russell LLP

(57) ABSTRACT

Provided is a stand-type portable antenna that adjusts elevation and azimuth with a single motor. The stand-type portable antenna has a waterproof structure in a form with the antenna opened, minimizing the size of a protective cover further accommodating an elevation driving range of the antenna. The elevation drive structure is independent from vibrations incurred by the azimuth adjustment of the antenna, thereby forming a structure in which a backlash between axes of the antenna is minimized.

6 Claims, 6 Drawing Sheets

(56) References Cited

U.S. PATENT DOCUMENTS

2002/0030631 A1* 3/2002 Verkerk ..... H01Q 3/08 343/757
2003/0214449 A1* 11/2003 King ..... H01Q 3/08 343/765
2004/0150574 A1* 8/2004 Harron ..... H04H 20/30 343/765
2005/0068241 A1* 3/2005 Desargant ..... H01Q 1/28 343/781 CA
2005/0280593 A1* 12/2005 Cha ..... H01Q 3/08 343/781 P
2006/0262022 A1* 11/2006 DeSargant ..... H01Q 3/08 343/781 CA
2007/0103366 A1* 5/2007 Park ..... H01Q 3/08 342/359
2007/0216592 A1* 9/2007 Park ..... H01Q 19/12 343/765
2008/0186242 A1* 8/2008 Shuster ..... H01Q 19/17 343/762
2008/0258988 A1* 10/2008 Son ..... H01Q 19/10 343/765
2009/0224988 A1* 9/2009 Park ..... H01Q 1/1257 343/703
2009/0231224 A1* 9/2009 Felstead ..... H01Q 3/08 343/882
2009/0262033 A1* 10/2009 King ..... H01Q 1/088 343/882
2010/0259458 A1* 10/2010 Mattis ..... H01Q 3/08 343/766
2010/0283696 A1* 11/2010 Park ..... H01Q 3/08 343/760
2014/0166843 A1* 6/2014 Bertocchi ..... H01Q 3/08 248/550
2014/0368393 A1* 12/2014 Shuster ..... H01Q 19/12 343/761
2017/0025752 A1* 1/2017 Zimmerman ..... H01Q 3/08
2017/0179566 A1* 6/2017 Hirabe ..... H04B 17/101
2018/0254554 A1* 9/2018 Sorrentino ..... H01Q 1/1264
2018/0301784 A1* 10/2018 Venghaus ..... H01Q 1/42
2018/0375188 A1* 12/2018 Patel ..... H01Q 1/1264
2021/0336321 A1* 10/2021 Gierow ..... H01Q 1/20
2021/0376460 A1* 12/2021 Park ..... H01Q 1/125

* cited by examiner

STAND-TYPE PORTABLE ANTENNA

CROSS-REFERENCE TO RELATED APPLICATIONS

The present application claims priority to Korean Patent Application No. 10-2019-0147688 filed on Nov. 18, 2019. The entire contents of the above-listed application is incorporated by reference for all purposes.

TECHNICAL FIELD

The following disclosure relates to a stand-type antenna for adjusting elevation and azimuth with a single motor, and more particularly, to a stand-type portable antenna having a partial waterproof structure.

BACKGROUND

An antenna for satellite communication faces a satellite by adjusting elevation and azimuth, that is, two axes, in which the elevation means an angle in a vertical direction from a ground and the azimuth means an angle in a horizontal direction based on an axis perpendicular to the ground. In general, the two axes are controlled to adjust the elevation and azimuth of the antenna.

The applicant of the present invention had also filed the Korean Patent Laid-Open Publication No. 10-2019-0040725 ("Biaxial antenna using single motor", published on Apr. 19, 2019), and the present invention improves those conventional problems of the prior art described below.

The antenna of the related prior art, in order to be installed outdoors, requires a radome covering to surround the entire antenna assembly for blocking foreign substances inflowing from the outside air and for waterproof. One problem is that the overall volume of antenna increases, and it makes that the storage and portability of the antenna assembly are strictly limited thereby. In addition, in order to prevent for the radio waves received being blocked and signal frames lost due to the radome covering, other problems of complicated circuit design technologies to be introduced and the production cost increases.

RELATED ART DOCUMENT

Patent Document

Korean Patent Laid-Open Publication No. 10-2019-0040725 ("Biaxial antenna using single motor", Apr. 19, 2019)

SUMMARY

An embodiment of the present invention is directed to providing a portable antenna that minimizes the size of a protective cover not only accommodating the elevation driving range of an antenna but also providing a waterproof structure while opened in use.

Another embodiment of the present invention is directed to provide a portable antenna that has a structure in which one side of an operation bracket supporting an antenna dish is hinged and fixed, and the other side thereof is driven in an up-down(vertical) direction to adjust the angle forming an elevation drive structure. This allows the elevation drive independent from vibrations incurred by the rotating drive for azimuth adjustment of the antenna, realizing thereby a structure in which a backlash between axes of the antenna is minimized.

In one general aspect, a stand-type portable antenna includes: an antenna unit configured to include an antenna dish that collects radio waves from a satellite and an operation bracket supporting the antenna dish, and a main driver configured to include a pair of side supports hinged and fixed to one side of the operation bracket, and a rotating body fixed to the other side of the operation bracket to adjust elevation of the antenna dish by up-down movement of the rotating body.

The main driver may further include a fixed central shaft with a thread formed on an outer circumferential surface thereof configured to be coupled to the rotating body with a thread formed on an inner circumferential surface thereof, a fixed pulley configured to be provided under the fixed central shaft and have the fixed central shaft received therein, a rotating plate configured to be connected to be rotatable from the fixed pulley and rotate with the pair of side supports, and a single motor configured to be provided on the rotating plate and connected to rotate the rotating plate in a horizontal direction, whereby the main driver adjusts azimuth and elevation of the antenna unit according to the rotation of the rotating plate.

The stand-type portable antenna may further include a support configured to be provided below the rotating plate and the stand configured to be seated on ground below the support to support the load of the antenna assembly, in which the support further includes a support coupling part configured to be provided above the support, fixed to a lower end of the fixed pulley of the main driver, and have a portion of the fixed central shaft received therein.

An inner diameter of the fixed pulley may be configured to have a larger diameter than the outer diameter of the fixed central shaft, whereby the fixed central shaft is independent from a torsion loaded to the fixed central shaft incurred by the rotational drive of the single motor.

The main driver may further include a lower bearing configured to be interposed between the fixed pulley and the rotating plate, an upper support configured to be fixed to cover and connect the upper portions of the pair of side supports, and an upper bearing configured to be interposed between the upper support and the fixed central shaft.

The stand-type portable antenna may further include a protective cover configured to be formed to surround the main driver and is provided to expose the antenna unit, the support, and the stand to the outside.

The stand-type portable antenna may further include a stopper configured to be provided to have one side fixed to the rotating plate and the other side on the outer circumferential surface of the fixed pulley fastening a drive belt surrounding the portion of the outer circumferential surface of the fixed pulley to prevent the rotation of the rotating plate.

Other features and aspects will be apparent from the following detailed description, the drawings, and the claims.

| Detailed Description of Main Elements | |
|---|---|
| 1000: Stand-type portable antenna | |
| 100: Antenna unit | |
| 110: Antenna dish | 120: Antenna bracket |
| 130: Operation bracket | 131: Hinge fixing part |
| 132: Elevation adjustment unit | |
| 140: Camera | 150: Camera bracket |
| 200: Main driver | |
| 210: Side support | 211: Fixed hinge |
| 212: Elevation fixing groove | |
| 220: Rotating body | 221: Fixed end |
| 230: Fixed central shaft | 231: Rotary joint |
| 240: Fixed pulley | 250: Rotating plate |
| 260: Single motor | 270: Lower bearing |
| 280: Upper support | 290: Upper bearing |
| 300: Support | 310: Support coupling part |
| 320: Support fixing bolt | |
| 400: Stand | 500: Protective cover |
| 600: Stopper | |
| B: Drive belt | G: Controller |
| D1: Inner diameter of fixed pulley | |
| D2: Outer diameter of fixed central shaft | |

DETAILED DESCRIPTION

The present invention may be variously modified and have several exemplary embodiments, and specific exemplary embodiments of the present invention will be illustrated in the accompanying drawings and be described in detail. However, it is to be understood that the present invention is not limited to a specific exemplary embodiment, but includes all modifications, equivalents, and substitutions without departing from the scope and spirit of the present invention.

It is to be understood that when one element is referred to as being "connected to" or "coupled to" another element, it may be connected directly to or coupled directly to another element, and it may also be construed as being connected to or coupled to another element with the other elements intervening therebetween.

Unless indicated otherwise, it is to be understood that all the terms used in the specification including technical and scientific terms have the same meaning as those that are generally understood by those who skilled in the art.

It must be understood that the terms defined by the dictionary are identical with the meanings within the context of the related art, and they should not be ideally or excessively formally taken unless the context clearly dictates otherwise.

Hereinafter, the technical spirit of the present invention will be described in more detail with reference to the accompanying drawings.

However, the accompanying drawings are only examples shown in order to describe the technical idea of the present invention in more detail. Therefore, the technical idea of the present invention is not limited to the structures of the accompanying drawings.

Figure 1:
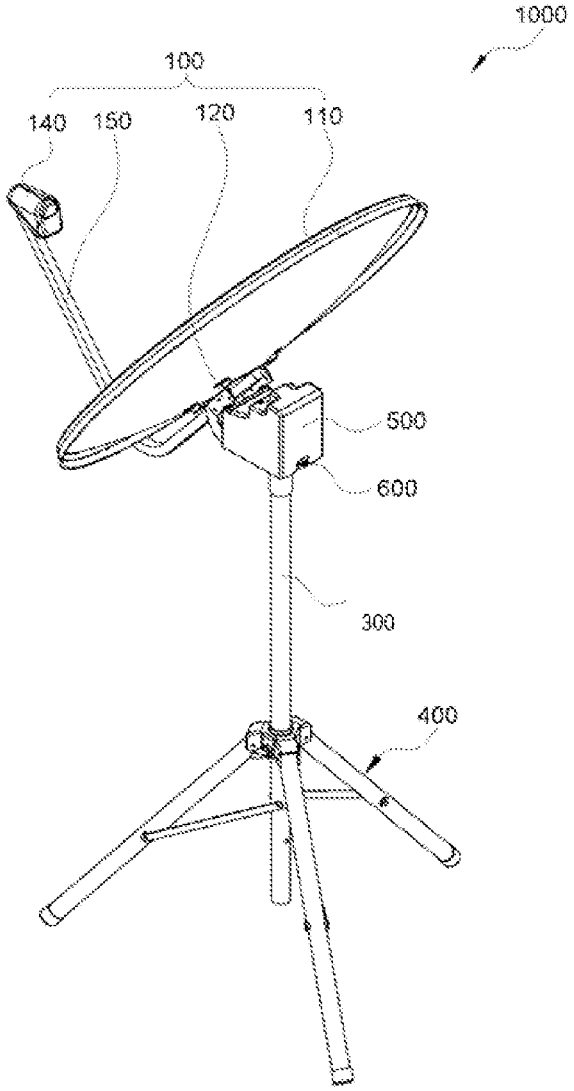
FIG. 1 is a perspective view illustrating a stand-type portable antenna according to an embodiment of the present invention.
Figure 2:
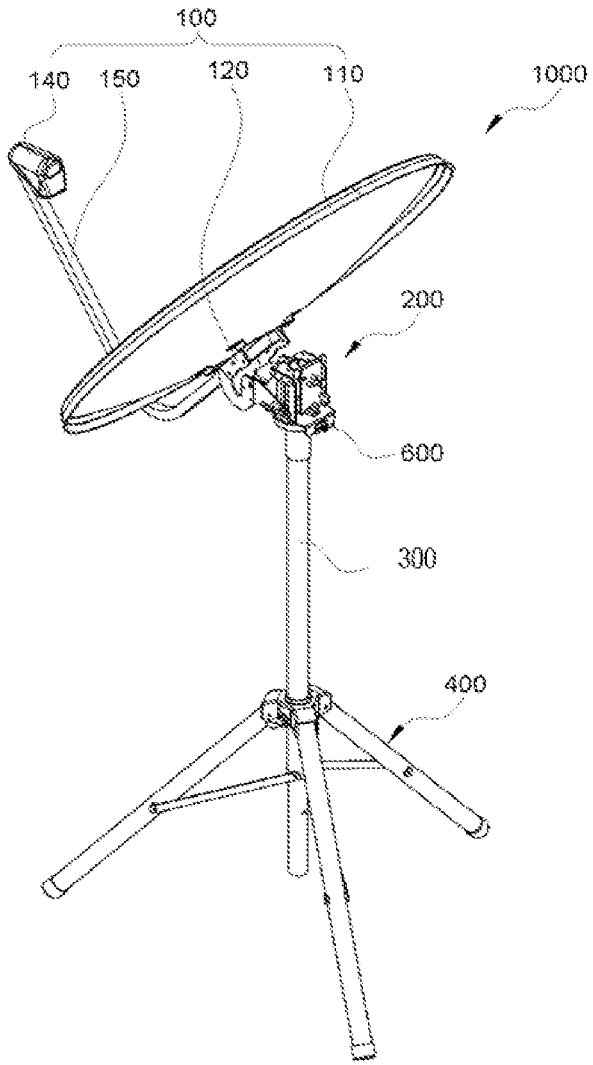
FIG. 2 is a perspective view illustrating the stand-type portable antenna without a protective cover.

FIG. 1 is a perspective view illustrating a stand-type portable antenna according to an embodiment of the present invention, and FIG. 2 is a perspective view illustrating a stand-type portable antenna without a protective cover. Referring to FIGS. 1 and 2, a stand-type portable antenna 1000 according to an embodiment of the present invention may be configured to include an antenna unit 100, a main driver 200, a support 300, a stand 400, a protective cover 500, and a stopper 600.

The antenna unit 100 includes an antenna dish 110 that collects radio waves from a satellite, an antenna bracket 120 that has one end coupled to a rear surface of the antenna dish 110 to support the antenna dish, an operation bracket 130 that is fixed to the other end of the antenna bracket 120 and hinged and coupled to the main driver 200 to adjust an elevation of the antenna dish 110, a camera 140 that collects radio signals received from the antenna dish 110, and a camera bracket 150 that has one end fixed to the antenna bracket 120 and the other end supporting the camera 140 and is configured to position the camera 140 in front of the antenna dish 110. The camera 140 may be configured to include a receiving module that receives a radio signal reflected from the antenna dish, and a low noise block downconverter (LNB) may be inclusive in the receiving module.

Here, the elevation means an angle between ground and a satellite aimed as a receiving point from which the antenna dish collects radio waves from the satellite. As a distance between the satellite and the antenna gets closer, the antenna dish 110 aims high upward and the angle between the direction of the antenna dish 110 faces and vertical axis of the antenna gradually decreases. In addition, the azimuth refers to an angle in a horizontal direction based on an axis perpendicular to the ground, and the main driver 200 rotates horizontally allowing the antenna dish 110 face the satellite.

The main driver 200 is fixed to rotate with the antenna unit 100, and has a 1.5-axis structure that adjusts the elevation and azimuth of the antenna unit 100 using a single driving motor, and this single motor may be configured to be assembled into the main driver 200 at the rear of the antenna dish 110. Here, the 1.5-axis structure means a structure in which that the rotation of both the antenna unit 100 and the main driver 200 in the horizontal direction (azimuth) and the rotation of the antenna unit 100 in the vertical direction (elevation) incurred by the horizontal rotation are simultaneously performed by using a single motor, which will be described in more detail below with reference to the drawings.

The protective cover 500 is formed to provide covering for the main driver 200 sealing inner part, while exposing the antenna unit 100, the camera 140, the support 300, and the stand 400 to its outside, then it is possible to make a waterproof structure to prevent leakage of water and penetration of foreign substances into the main driver 200.

In more detail, the protective cover 500 offers a covering of the upper portion of the main driver 200, and is preferably bent and extends downwardly to the front side of the main driver 200 facing rear side of the antenna dish 110 so that only the corresponding portion of the antenna bracket 120 of the antenna unit 100 protrudes outwardly. More precisely, the antenna bracket 120 has one end portion that is fixed to the rear surface of the antenna dish 110, and the other end portion is coupled to the outer end of the operation bracket 130. One end of the operation bracket 130 is fixed to both of the side supports 210 in the main driver 200 and the other ends are extended integrally out of the protective cover 500 to be coupled to the other end portion of the antenna bracket 120. Here, the protective cover 500 provides covering the top of the main driver 200 and its front part is bent downward blocking the front side of the main driver 200 from the connecting parts of the antenna bracket 120. That is, the main driver 200 is spatially divided from the coupling of the exterior antenna unit, and the protective cover 500 is preferably configured to rotate with the main driver 200.

The support 300 and the stand 400 are provided under the main driver 200 to support the load of the main driver 200 and the antenna unit 100, and the support 300 provided under a rotating plate of the main driver 200 extends vertically down to have a predetermined length, and may have a coupling at the lower end of the support 300 to be seated on the ground, and also may include a stand 400 to form a ground base. The stand 400 may be configured to have a plurality of legs provided to be separately downward and unfolded, and may further include a plurality of couplings to the support 300 forming legs to distribute the load.

Figure 3:
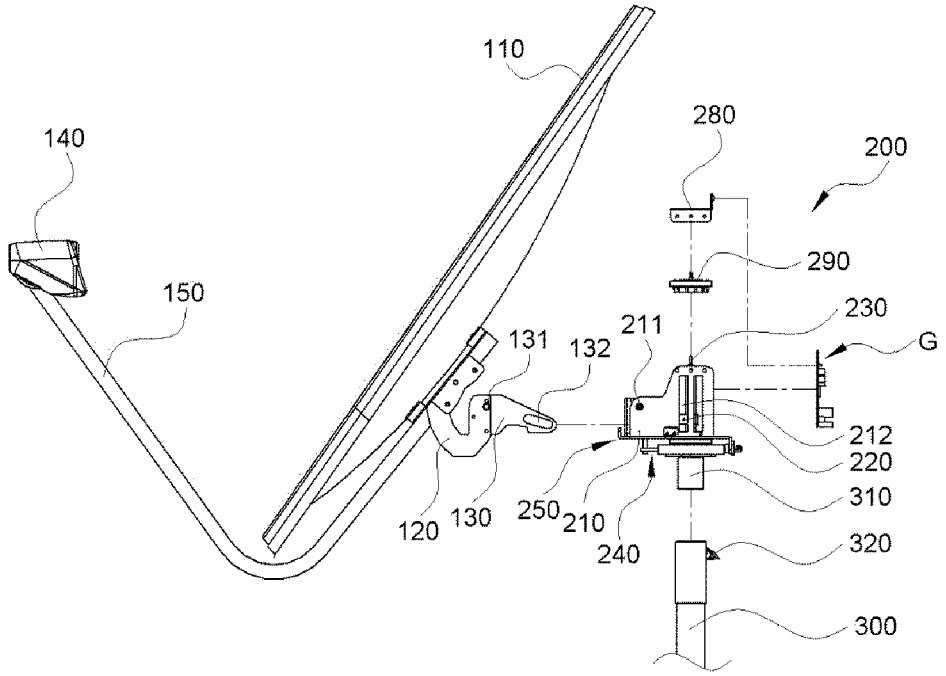
FIG. 3 is an enlarged view of the assembly of the main driver according to an embodiment of the present invention.
Figure 4:
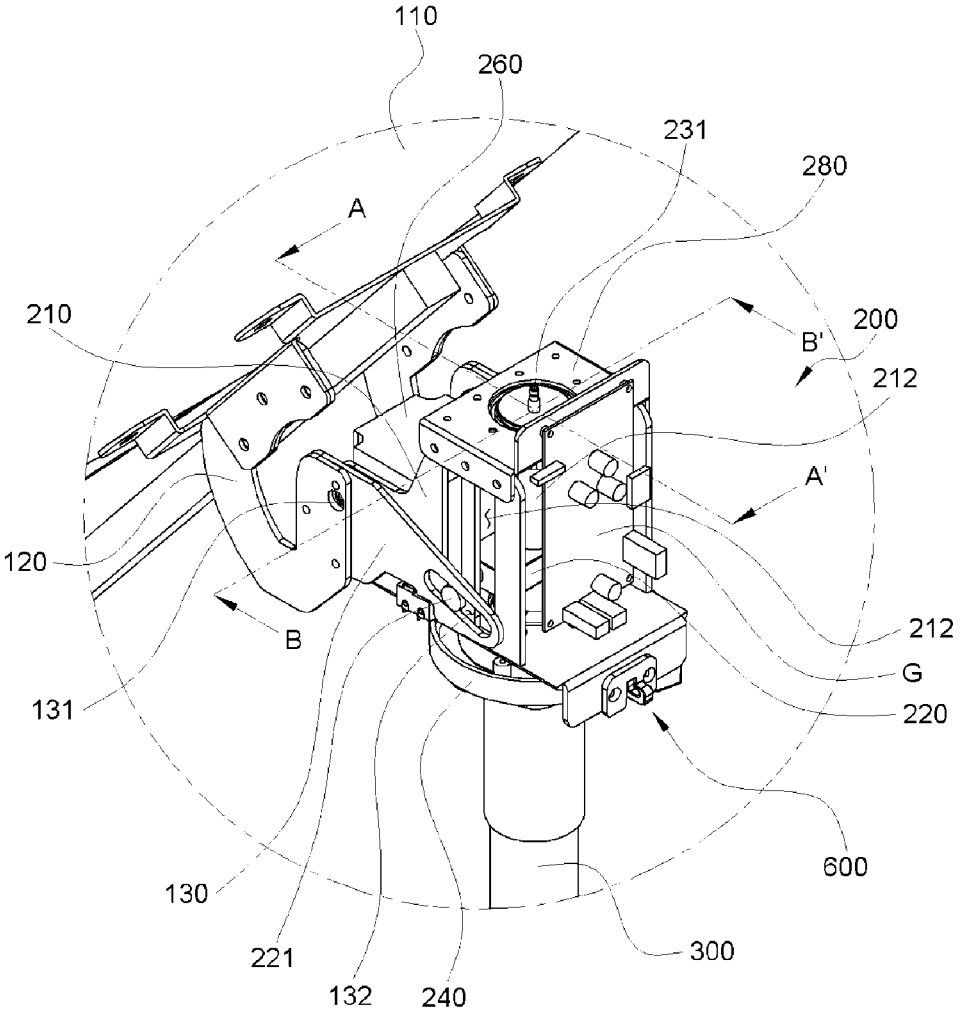
FIG. 4 is an enlarged perspective view of the main driver according to the embodiment of the present invention.
Figure 5:
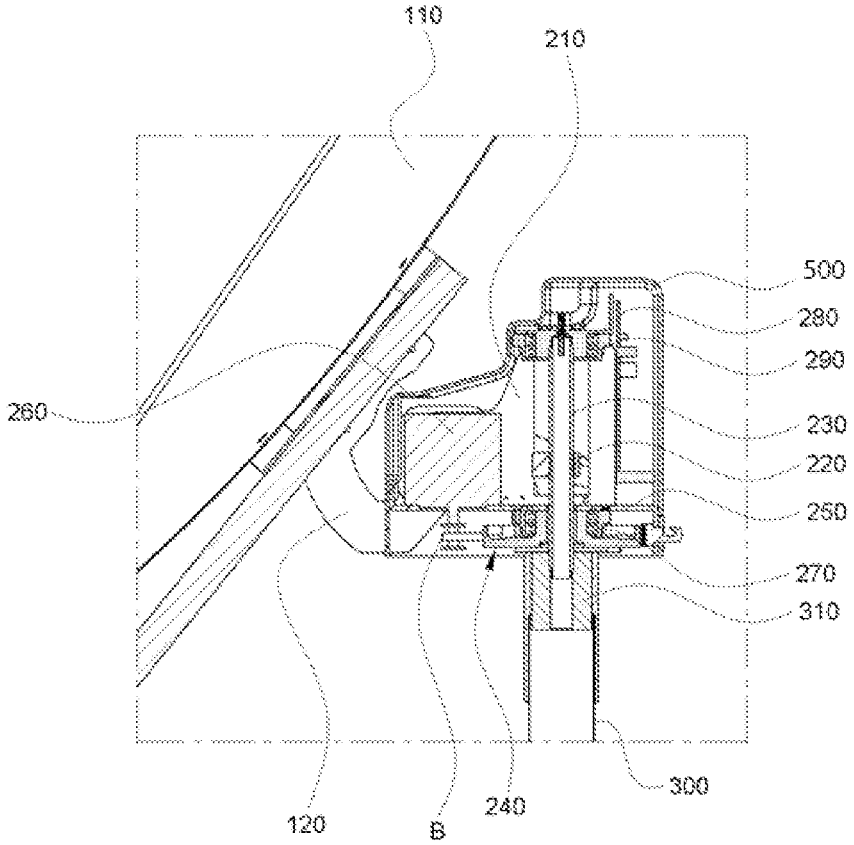
FIG. 5 is a cross-sectional view taken along line AA' of FIG. 4.
Figure 6:
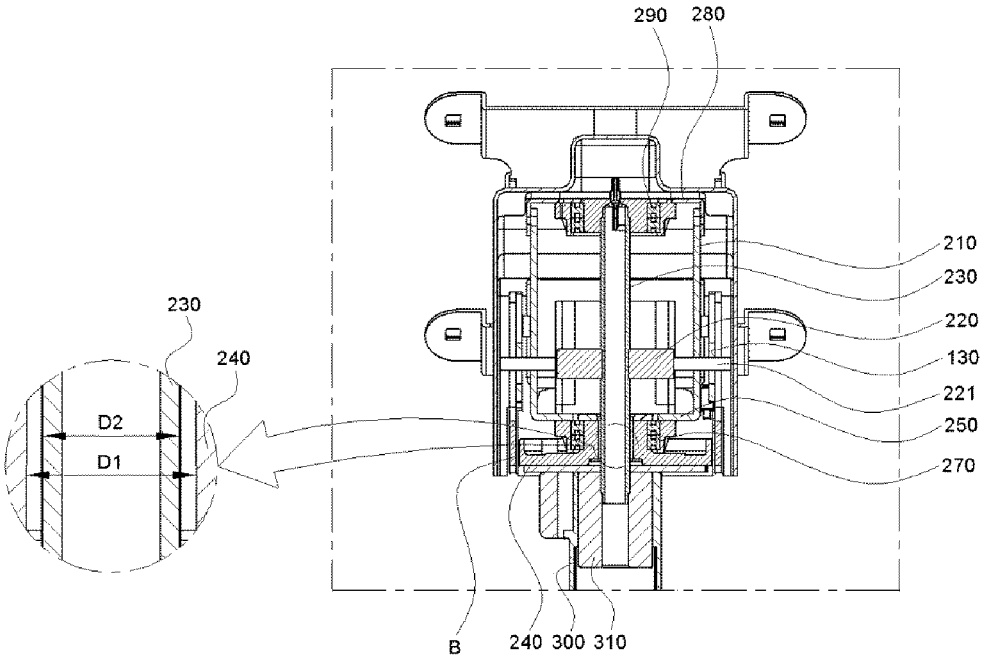
FIG. 6 is a cross-sectional view taken along line BB' according to FIG. 4.

FIG. 3 and FIG. 4 are an enlarged side view and perspective view respectively of the main driver according to an embodiment of the present invention. FIG. 5 and FIG. 6 are cross-sectional views taken along the line AA' and the line BB' of FIG. 4 respectively. Referring to FIGS. 3 to 6, the 1.5-axis structure of the main driver 200 of the stand-type portable antenna 1000 and the coupling structure between the antenna unit 100 and the support 300 according to the present invention will be described in more detail.

First, the main driver 200 may include a pair of side supports 210 that supports hinged and fixing assembly at their front ends with the hinge fixing part 131 provided at one side of the operation bracket 130 of the antenna unit 100. A rotating body 220 coupled to an elevation adjustment unit 132 formed on the other side of the operation bracket 130, thereby adjusting the elevation of the antenna unit 100 by the up-down movement of fixed end 221, a fixed central shaft 230 with its outer circumferential surface provided with a thread that is coupled to the rotating body 220 with inner circumferential surface provided with a thread therein, a fixed pulley 240 that is provided under the fixed central shaft 230 and has the fixed central shaft 230 received therein, a rotating plate 250 that is rotatably connected from the fixed pulley 240 to rotate with the pair of side supports 210, a single motor 260 that is provided on the rotating plate 250 to rotate the rotating plate 250 in a horizontal direction, a lower bearing 270 interposed between the fixed pulley 240 and the rotating plate 250, an upper support 280 that is fixed to connect upper portions of the pair of side supports 210, and an upper bearing 290 interposed between the upper support 280 and the fixed central shaft 230.

That is, the rotating plate 250 and the fixed pulley 240 are assembled to be independent of each other by a lower bearing 270 interposed therebetween, and the rotating plate 250 rotates horizontally by the rotational force of the single motor 260 provided on the rotating plate 250, so the main driver 200 according to the above-described configuration adjusts the azimuth of the antenna unit 100. Here, a drive belt B connected to the shaft of the single motor 260 is extended and fastened to surround the outer circumferential surface of the fixed pulley 240. Then, when the belt B is driven by the rotational force of the single motor 260, the rotating plate 250 coupled rotatable independently by the lower bearing 270 above the fixed pulley 240, rotates by applied reactive force against the fixed pulley 240 and the support 300.

Fixed with the pair of operation brackets 130 coupled to the pair of side supports 210 thereby with the rotating plate 250, the antenna unit 100 rotates in parallel with the rotation of the rotating plate 250 in the horizontally. With the rotation of the rotating plate 250 in the horizontal direction, a pair of the side supports 210 coupled to the pair of operation brackets 130 via the fixed ends 221 that are integrally provided at both sides of the rotating body 220, drives the elevation adjustment unit 132 of the operation bracket 130 in an up-down direction along the fixed central shaft 230 fixed to the inside of the fixed pulley 240. The hinge fixing part 131 provides on both sides of the operation bracket 130 fulcrum to the fixed hinges 211 of the side supports 210, and the up-down movement of the elevation adjustment unit 132 provided by the fixed ends 221 of the rotating body 220 drives the adjustment of elevation of the antenna dish 110. Here, the elevation adjustment unit 132 of the operation bracket 130 is spaced to have a predetermined length in which the elevation adjustment unit 132 distanced with the hinge fixing part 131 and has a clearance so that the fixed end 221 of the rotating body 220 inserted thereinto may move by a predetermined length. That is, the fixed end 221 of the rotating body 220 moves along the clearance of the elevation adjustment unit 132, and the distance between the hinge fixing part 131 of the operation bracket 130 and the rotating body 220 may be designed to allow an increased range of elevation, thereby reducing the size of the main driver 200 in the front-rear direction. In addition, the side support 210 may have a plurality of elevation fixing grooves 212 formed in a predetermined distance in the up-down direction to accept the fixing end 221 of the rotating body 220, and the fixed end 221 of the rotating body 220 is fastened to any one of the plurality of elevation fixing grooves 212 to adjust the elevation range according to the size of the antenna dish 110, then the side support 210 can be simply attached and detached corresponding to various sizes of the antenna dish 110.

That is, the main driver 200 of the present invention according to the above-described configuration rotates the operation bracket 130 supporting the antenna dish 110 to adjust the elevation based on the hinge fixing part 131. This may prevent the shaking between the axes due to the rotation in the horizontal direction by the elevation adjustment unit 132 fastened to the other side of the pair of operation brackets 130, thereby significantly reducing the backlash to the antenna dish 110.

In addition, the fixed central shaft 230 is independent from the components rotating with the rotating plate 250. That is, the up-down movement of the rotating body 220 with the rotation of the rotating plate 250 is guided by the fixed central shaft 230, which is configured not to rotate. More preferably, the fixed central shaft 230 further includes a support coupling part 310 fixed on the upper portion of the support 300. The support coupling part 310 is provided below the rotating plate 250 and fixed on the lower surface of the fixed pulley 240, thereby receiving the lower portion of the fixed central shaft 230 couples the fixed central shaft 230 with the support 300. By preventing the torque loaded on the fixed pulley 240 transferred to the fixed central shaft 230, it is possible to adjust the elevation more precisely, excluding the disturbance from the up-down movement of the rotating body 220 guided by the fixed central shaft 230. Here, the inner diameter D1 of the fixed pulley 240 is configured to have larger diameter than the outer diameter D2 of the fixed central shaft 230, and thus, the fixed central shaft 230 is preferably configured to be free from the torsion loaded from the fixed pulley 240 with the rotation of the single motor 260.

In addition, with the upper bearing 290, top of the fixed central shaft 230 is coupled to the upper support 280, and thus, the fixed central shaft 230 is free from the rotation of the upper support 280 with the pair of side supports 210. Centered and supported by the fixed central shaft 230 with the upper bearing 290, the rotation of the upper support 280 and both side supports 210 may be more firmly secured.

In addition, the antenna 1000 of the present invention may further include a stopper 600 that has one side fixed to the rotating plate 250, and the other side provided to press the drive belt B, which partially surrounds the outer circumferential surface of the fixed pulley 250, to adjust the rotation of the rotating plate 250.

The present invention according to the above configuration may provide the stand-type portable antenna which has the waterproof structure with minimizing the size of the protective cover of the 1.5-axis antenna, in which the elevation and azimuth of the antenna are adjusted by the single motor.

In addition, the present invention provides the stand-type portable antenna that has the structure in which one side of an operation bracket supporting the antenna unit is hinged and fixed and the other side thereof is driven in an up-down direction to adjust the elevation to form the elevation drive structure, that is independent from vibrations occurring when rotating according to the azimuth adjustment of the antenna, thereby forming the structure in which the backlash between the axes of the antenna is minimized.

The present invention is not limited to the abovementioned exemplary embodiments, but may be variously applied, and may be variously modified without departing from the gist of the present invention claimed in the claims.

The invention claimed is:

1. A stand-type portable antenna, comprising:

an antenna unit configured to include an antenna dish that collects radio waves from a satellite and an operation bracket that is coupled to a rear surface of the antenna dish to support the antenna dish, wherein the operation bracket is further provided with a hinge fixing part at one portion and is also provided with an elevation adjustment unit having a predetermined length at another side of the operation bracket; and a main driver configured to include a pair of side supports that is hinged to the hinge fixing part and a rotating body having two fixed ends which are inserted into the elevation adjustment unit, wherein the main driver further includes:

a fixed central shaft having an outer circumferential surface with a thread configured to be coupled to the rotating body provided with a thread on an inner circumferential surface;

a fixed pulley configured to be coupled therein to receive a lower portion of the fixed central shaft;

a rotating plate configured to be connected to the fixed pulley to rotate with the pair of side supports; and a single motor configured to be provided on the rotating plate to drive the rotating plate in a horizontal direction, where by the main driver adjusts an azimuth by rotating the antenna unit together with the rotating plate, and further adjusts an elevation of the antenna unit by a move of the operation bracket about the hinge fixing part with a move of the rotating body upward or downward along the fixed central shaft driven by the rotating plate.

2. The stand-type portable antenna of claim 1, further comprising:

a support configured to be provided under the rotating plate; and a stand configured to be seated on a ground under the support, wherein the support further includes a support coupling part configured to be provided above the support, fixed to a lower end of the fixed pulley of the main driver, and having a portion of the fixed central shaft received therein.

3. The stand-type portable antenna of claim 2, wherein an inner diameter of the fixed pulley has a larger diameter than an outer diameter of the fixed central shaft.

4. The stand-type portable antenna of claim 2, wherein the main driver further includes:

a lower bearing configured to be interposed between the fixed pulley and the rotating plate;

an upper support configured to be fixed to connect upper portions of the pair of side supports; and an upper bearing configured to be interposed between the upper support and the fixed central shaft.

5. The stand-type portable antenna of claim 2, further comprising:

a protective cover configured to be formed to surround the main driver.

6. The stand-type portable antenna of claim 1, further comprising:

a stopper configured to have one side fixed to the rotating plate and another side provided on the outer circumferential surface of the fixed pulley to press a drive belt surrounding a portion of the outer circumferential surface of the fixed pulley to prevent rotation of the rotating plate.

* * * * *